US007973626B2

(12) United States Patent
Gerner

(10) Patent No.: US 7,973,626 B2
(45) Date of Patent: Jul. 5, 2011

(54) APPARATUS FOR POSITION RECOGNITION

(75) Inventor: Herbert Gerner, Erlenmoos (DE)

(73) Assignee: Liebherr-Hausgeratte Ochsenhausen GmbH, Ochsenhausen (DE)

( * ) Notice: Subject to any disclaimer, the term of this patent is extended or adjusted under 35 U.S.C. 154(b) by 950 days.

(21) Appl. No.: 11/506,180

(22) Filed: Aug. 16, 2006

(65) Prior Publication Data

US 2007/0199501 A1 Aug. 30, 2007

(30) Foreign Application Priority Data

Aug. 18, 2005 (DE) ..... 20 2005 013 065 U

(51) Int. Cl.
*H01H 9/00* (2006.01)

(52) U.S. Cl. ..... 335/205

(58) Field of Classification Search ..... 335/205
See application file for complete search history.

(56) References Cited

U.S. PATENT DOCUMENTS

| | | | | | |
|---|---|---|---|---|---|
| 3,164,696 | A * | 1/1965 | Pusch | 335/274 |
| 4,241,337 | A * | 12/1980 | Prada | 340/547 |
| 4,336,518 | A * | 6/1982 | Holce et al. | 335/205 |
| 4,656,781 | A * | 4/1987 | Niekrasz et al. | 49/404 |
| 4,707,684 | A * | 11/1987 | Janke et al. | 340/530 |
| 5,120,118 | A * | 6/1992 | Rankin | 312/402 |
| 5,541,562 | A * | 7/1996 | Fletcher et al. | 335/205 |
| 5,856,781 | A * | 1/1999 | Michel et al. | 340/547 |
| 6,249,224 | B1 * | 6/2001 | Shoen et al. | 340/545.2 |
| 6,359,538 | B1 * | 3/2002 | Jolley et al. | 335/205 |
| 6,446,459 | B1 * | 9/2002 | Sawhney et al. | 62/440 |
| 6,447,083 | B1 * | 9/2002 | Chiapetta et al. | 312/404 |
| 2003/0030522 | A1 * | 2/2003 | Kasashima et al. | 335/205 |
| 2004/0100254 | A1 | 5/2004 | Viitanen | |

FOREIGN PATENT DOCUMENTS

| | | |
|---|---|---|
| DE | 32 18 298 | 12/1982 |
| DE | 197 36 454 | 2/1999 |
| DE | 198 05 225 | 8/1999 |
| DE | 102 27 699 | 1/2004 |
| DE | 102 48 148 | 4/2004 |

* cited by examiner

*Primary Examiner* — Elvin G Enad
*Assistant Examiner* — Alexander Talpalatskiy
(74) *Attorney, Agent, or Firm* — Alleman Hall McCoy Russell & Tuttle LLP

(57) ABSTRACT

The invention relates to an apparatus for position detection having a magnet and a sensing element which has switched states or parameter values depending on the magnetic field generated by the magnet, with the apparatus furthermore having a means for influencing the magnetic field, with the means being made and arranged such that different switched states or parameter values of the sensing element can be generated in dependence on the position of the magnet, the sensing element and the means for influencing the magnetic field with respect to one another.

5 Claims, 4 Drawing Sheets

APPARATUS FOR POSITION RECOGNITION

CROSS-REFERENCE TO RELATED APPLICATION

Figure 1A:
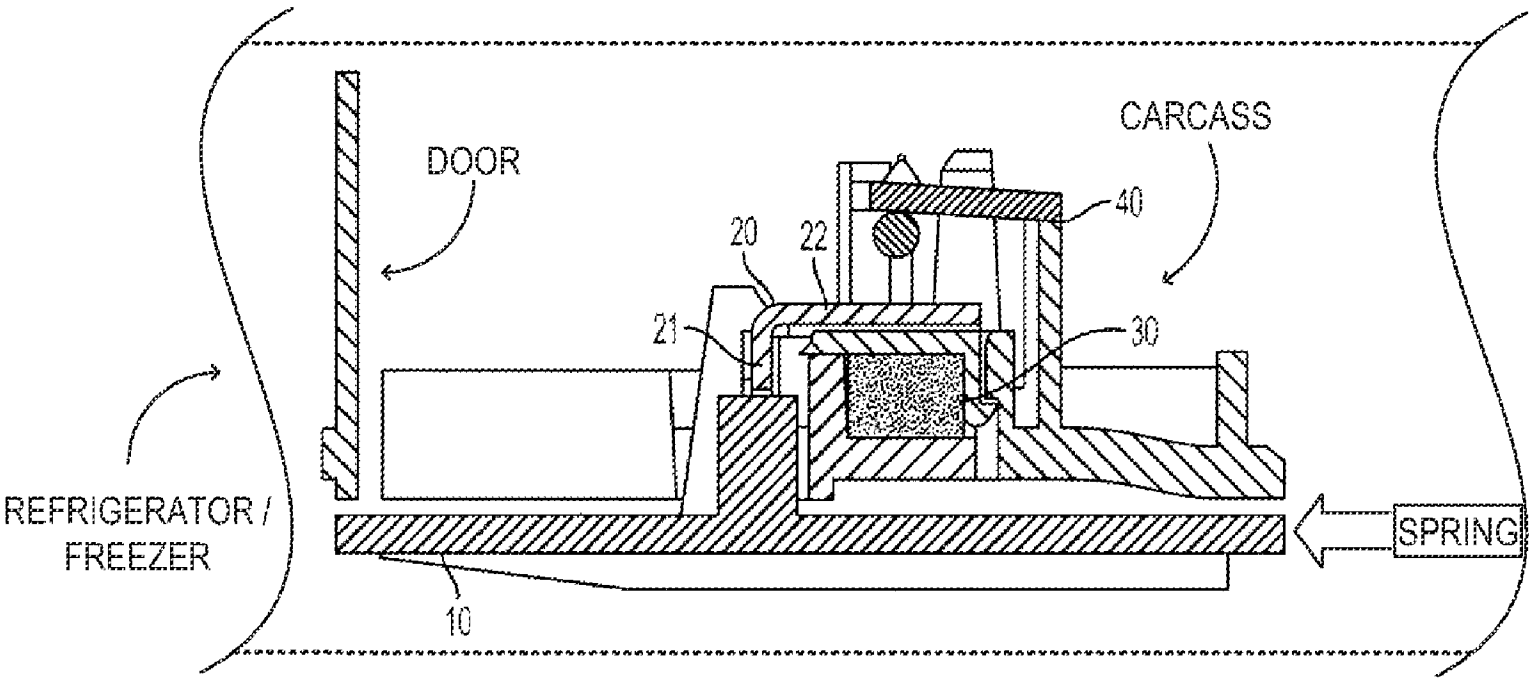

This application claims priority to German Utility Model Application Serial No. 20 2005 013 065.6 filed Aug. 18, 2005, which is hereby incorporated by reference in its entirety for all purposes.

The present invention relates to an apparatus for position detection using a magnet and a sensing element having switched states or parameter values dependent on the magnetic field generated by the magnet.

Arrangements of this type having for example a sensing element designed as a reed switch and a magnet for position detection are known. The reed switch has contact springs made of ferromagnetic material. They are attracted to one another under the effect of a magnetic field generated by the magnet and so close a contact circuit. If the magnet is moved away from the reed switch, the influence of the magnet on the contact springs is discontinued and the contact opens again due to the mechanical restoring forces of the springs.

Arrangements of this type are also known inter alia for the detection of the door position.

However, these arrangements have a certain variance due to the reed switch tolerances and selections, which has the result that the switching on and switching off points are subject to corresponding tolerances.

It is therefore the object of the present invention to further develop an apparatus for position detection of the initially named type such that the variance and/or the tolerance range is reduced.

This object is solved in that the apparatus furthermore has means for the influencing of the magnetic field, with the means being made and arranged such that different switched states or parameter values of the sensing element can be generated in dependence on the position of the magnet, the sensing element and the means for the influencing of the magnetic field with respect to one another. The idea of the invention thus consists of the field lines emanating from the magnet being influenced in a direct manner by the means for the influencing of the magnetic field such that the magnetic field acting on the sensing element is variable. It is, for example, conceivable to substantially reduce the named error tolerances by a direct shielding of the field lines from a reed switch by means of a ferromagnetic material.

Accordingly, a preferred aspect of the invention consists of the means for the influencing of the magnetic field having a ferromagnetic material or consisting thereof. The use of a magnetically conductive material or of a material having magnetic permeability is generally conceivable.

The apparatus in accordance with the invention can thus consist of a magnet, a sensing element such as a reed switch, and e.g. a ferromagnetic material of different shape and thickness. A steel plate can, for example, be considered.

Provision can be made for the generation of different switched states or parameter values of the sensing element to make the magnet, the means for influencing the magnetic field or also the sensing element or a plurality of these components movable so that the components are movable into different positions relative to one another. A differing magnetic field acting on the sensing element results in dependence on these positions. The position of the door of a unit can, for example, be sensed on this basis.

It is thus conceivable for the means for the influencing of the magnetic field to be made movable for the generation of different switched states or parameter values and for the magnet and the sensing element to be made stationary. It is likewise conceivable for the magnet to be made movable for the generation of different switched states or parameter values and for the means for the influencing of the magnetic field and of the sensing element to be made stationary. Provision is made in another aspect of the invention for the sensing element for the generation of the different switched states or parameter values to be made movable and for the magnet and the means for the influencing of the magnetic field to be made stationary.

As stated above, provision can also be made for more than one component of the apparatus in accordance with the invention to be arranged in a movable manner.

It is important that different positions of the components of the apparatus can be realized with respect to one another which result in a corresponding differing influencing of the magnetic field acting on the sensing element or of the screening of the field lines.

The design of the sensing element can largely be as desired. It is of importance that it is an element whose parameter values or switched state depends in a detectable manner on a magnetic field. Examples for the sensing element are a reed switch, a Hall sensor or a magnetoresistive component. A magnetoresistive component is characterized in that the conductance of the resistor varies under the effect of a magnetic field.

Provision is made in a preferred aspect of the invention for the means for the influencing of the magnetic field to be introducible into and removable from a space or gap between the magnet and the sensing element. The degree of shielding or influencing of the field lines by the sensing element thus depends on the position of the means for influencing the magnetic field. If this means is located in the space or gap between the magnet and the sensing element, a complete or large shielding of the field lines from the reed switch or the sensing element occurs, whereby a specific switched state or a specific state of the sensing element is brought about. If the sensing element is a Hall sensor, the Hall voltage is preferably used to determine whether or to which degree the influencing by a magnetic field is present.

If the means for the influencing of the magnetic field is removed from the named space or gap, a full loading of the sensing element with the magnetic field occurs, whereby a different switched state or different values of one or more state variables of the sensing element result.

The means for the influencing of the magnetic field can be as desired per se in shape and design. A plate or also a metal sheet, preferably a steel plate, can be considered.

Provision is made in a further aspect of the invention for the means for the influencing of the magnetic field to be arranged in at least one position such that it covers the poles of the magnet.

The magnet of the apparatus can be a permanent magnet or a magnet which generates a magnetic field by means of an excitation coil.

The invention further relates to a refrigerator unit and/or a freezer unit having an apparatus as disclosed herein.

Provision is preferably made in this connection for the apparatus for the detection of the position of the door of the unit to be used. This can apply to the door closing the unit at the front side or also to doors, flaps or drawers of individual compartments of the unit.

In a further aspect of the invention, provision is made for the sensing unit and the magnet to be arranged on the carcass of the unit and for the means for the influencing of the magnetic field to be arranged at the door of the unit. Other arrangements of the elements of the apparatus are also conceivable. It is, for example, also conceivable that the sensing unit and the magnet are arranged stationary on the carcass of the unit and that the means for the influencing of the magnetic field is arranged movable on the carcass such that it is movable by the door.

It is thus conceivable, for example, that a metal cover plate is arranged at the door or at the carcass of the unit which is introduced in a space or gap between a reed switch and the magnet in the closed state of the door and is removed from this space or gap in the open state of the door. Different switched states or state variables of the sensing element thus result which can be detected in a suitable manner and can thus be used for the detection of the position of the door.

The unit can e.g. be a refrigerator, a freezer, a fridge/freezer combination, a wine chiller or a wine storage cabinet.

Figure 1B:
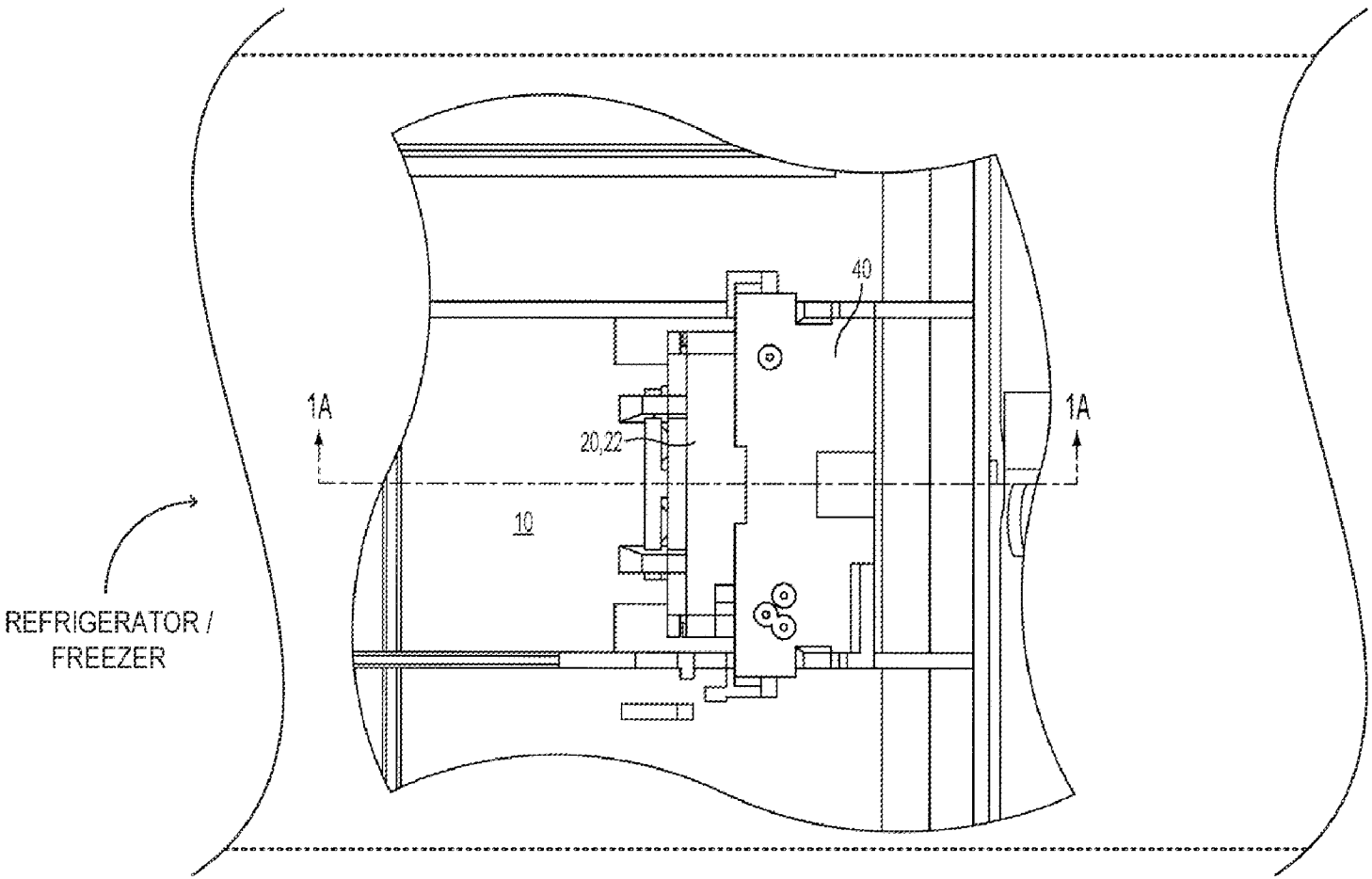
Figure 2A:
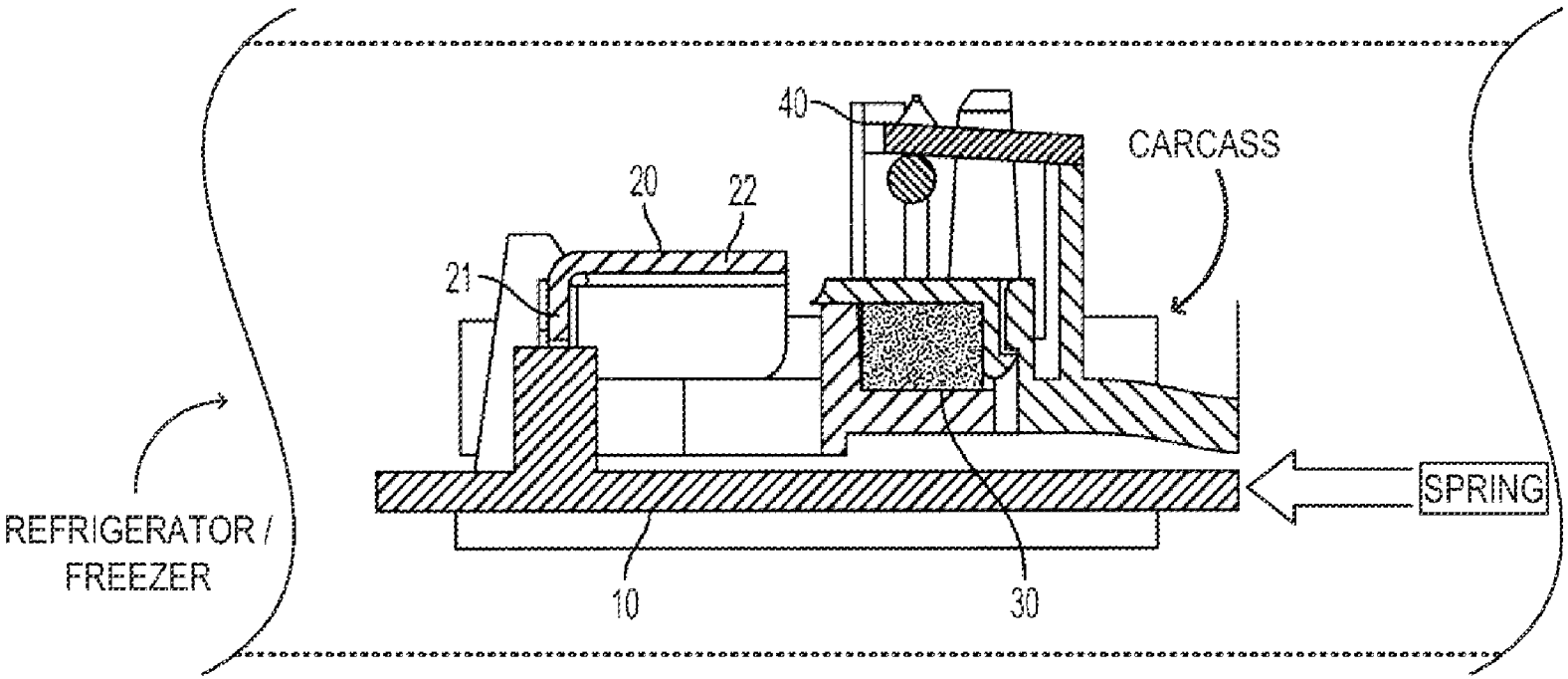
Figure 2B:
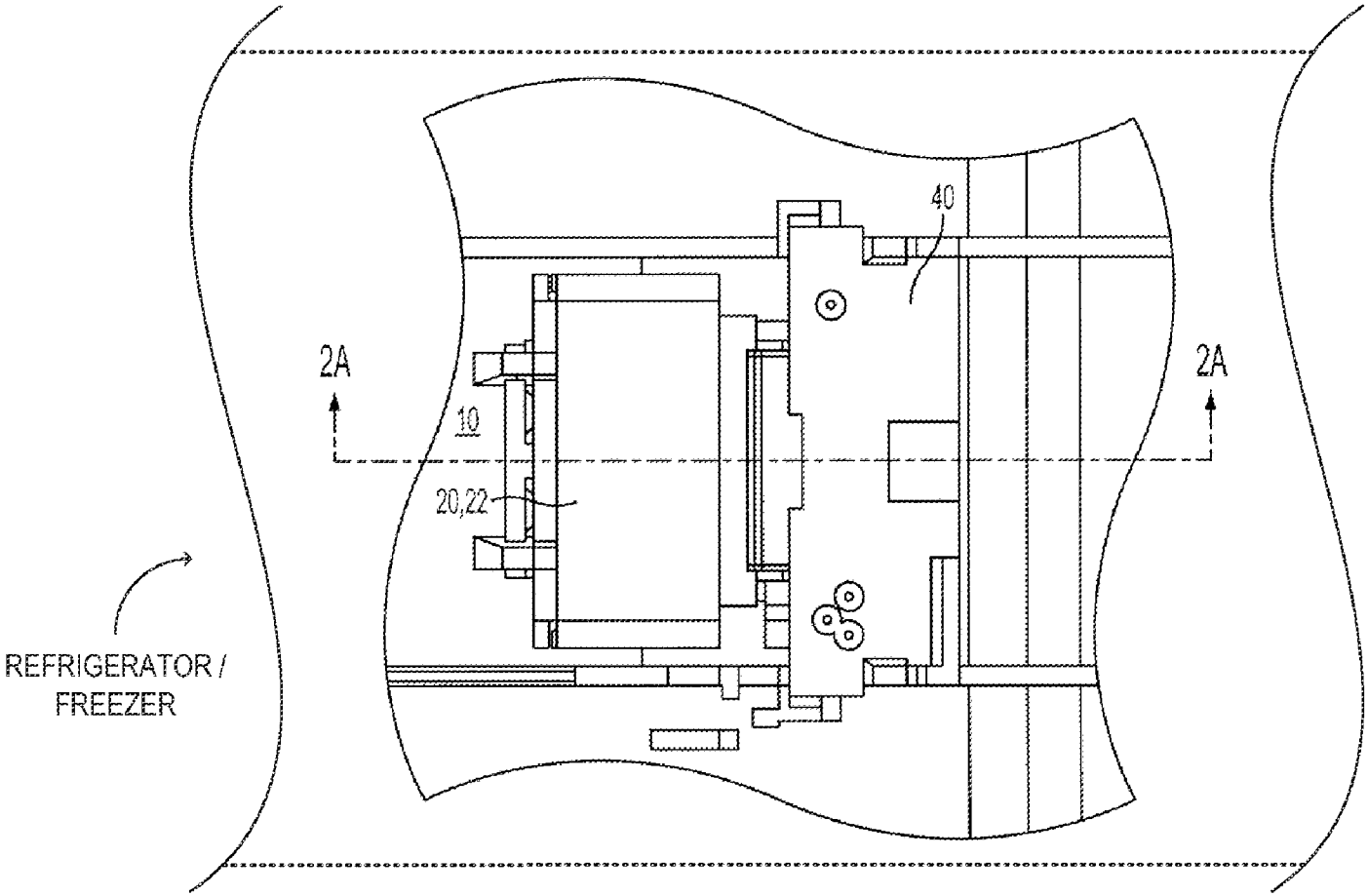

Further details and advantages of the invention will be explained in more detail with reference to an embodiment shown in the drawing. There are shown:

FIG. 1: a sectional representation (FIG. 1A) and a plan view (FIG. 1B) through the apparatus in accordance with the invention with a moved-in metal cover sheet; and FIG. 2: a sectional representation (FIG. 2A) and a plan view (FIG. 2B) of the apparatus in accordance with the invention with a moved-out metal cover sheet.

The top of FIG. 1 shows a sectional representation through the apparatus in accordance with the invention. The slider rail 10 can be recognized which is arranged horizontally movable at the carcass of a refrigerator and/or freezer unit such that it can be moved through the door of the unit. The metal cover sheet 20 bent at right angles is located on the slider rail 10. The former has a limb 21 extending perpendicular to the slider rail 10 and a limb 22 extending perpendicular thereto and parallel to the slider rail 10.

The apparatus furthermore has a magnet 30 and a reed switch or a reed plate 40.

FIG. 1, lower illustration, shows the plan view of the apparatus in accordance with the invention. The sectional line in accordance with A-A in FIG. 1, lower illustration, is shown in FIG. 1, upper illustration. FIG. 1 shows a state in which the slider rail 10 is displaced into its right end position. In this position, the horizontally extending limb 22 of the metal cover sheet 20 extends in the space between the reed plate 40 and the magnet 30. In this position of the metal cover plate 20, the reed plate 40 or the reed switch experiences no or hardly any influencing by the magnetic field generated by the magnet 30.

This state can occur in the closed position of the unit door.

As stated above, a Hall sensor or a magnetoresistive component can, for example, equally be used instead of the reed switch. They emit characteristic values such as a voltage or a resistance value which can likewise be used to determine whether or to what degree an influencing of this component by a magnetic field is present.

The slider rail 10 can be arranged at the door of a refrigerator or freezer unit or at the carcass such that it is actuated by the door. In both cases, the slider rail 10 is moved in dependence on the position of the door.

FIG. 2 shows the apparatus in accordance with the invention with a moved-out metal cover plate 20.

FIG. 2, upper illustration, is the sectional view in accordance with line B-B in FIG. 2, lower illustration, which shows a plan view of the arrangement in accordance with the invention. It results from FIG. 2 that the metal cover plate consisting of ferromagnetic material is now removed from the space between the reed plate 40 and the magnet 30 so that the magnet 30 or its field lines act on the reed switch 40 and set it into a closed state. This case can occur, for example, when the door is open.

The slider rail 10 can be spring-loaded so that it is located in the position shown in FIG. 2 with a lack of influencing by the door of the unit.

The invention claimed is:

1. A refrigerator and/or freezer unit comprising:

a door;

an apparatus for detecting a position of the door, the apparatus having a magnet, a sensing element responsive to a magnetic field generated by the magnet, and a ferromagnetic material; and a movable slider rail arranged at a carcass of the unit and configured to move substantially horizontally in dependence on the position of the door, wherein the magnet, the sensing element, and the ferromagnetic material are positioned such that different states of the sensing element are generated in dependence on a position of the magnet, the sensing element, and the ferromagnetic material with respect to one another;

wherein the magnet and the sensing element are arranged stationary on the carcass of the unit and the ferromagnetic material is disposed on the slider rail and is movably actuated by the door, such that the ferromagnetic material is removed from between the magnet and the sensing element when the door is open, and extends between the magnet and the sensing element when the door is in a closed position, and wherein the slider rail is spring-loaded, with a spring coupled between the slider rail and the carcass, such that the ferromagnetic material is removed from between the magnet and the sensing element with lack of influencing by the door of the unit.

2. The refrigerator and/or freezer unit of claim 1, wherein the unit is one or more of a refrigerator, a freezer, a refrigerator/freezer combination, a wine chiller, and a wine storage cabinet.

3. The refrigerator and/or freezer unit of claim 1, wherein the apparatus comprises only one magnet.

4. The refrigerator and/or freezer unit of claim 1, wherein the sensing element comprises one or more of a reed switch and a Hall-effect sensor.

5. The refrigerator and/or freezer unit of claim 1, wherein the different states of the sensing element comprise switched states or parameter values dependent on the magnetic field.

* * * * *